United States Patent [19]

Gandini

[11] 3,946,221

[45] Mar. 23, 1976

[54] ORIENTABLE LIGHTING FIXTURE

[76] Inventor: Sergio Gandini, via Tosio 20, Brescia, Italy

[22] Filed: Nov. 25, 1974

[21] Appl. No.: 526,836

[30] Foreign Application Priority Data

Dec. 21, 1973 Italy ..... 7082/73

[52] U.S. Cl. ..... 240/128; 240/135; 240/142

[51] Int. Cl.[2] ..... F21V 17/00

[58] Field of Search ..... 240/10 R, 10 S, 108 R, 240/108 A, 108 B, 108 D, 78 D, 128, 135, 145, 142

[56] References Cited

UNITED STATES PATENTS

| | | | |
|---|---|---|---|
| 2,172,757 | 9/1939 | Pollock | 240/10 S |
| 2,680,841 | 6/1954 | Boutelle | 240/78 D X |
| 3,769,504 | 10/1973 | Hesse et al. | 240/108 D X |

*Primary Examiner*—Joseph F. Peters, Jr.

[57] ABSTRACT

An orientable lighting fixture comprising a central support carrying the light bulb sockets, a plurality of flexible rods connected to the central support and flexibly converging in pairs each pair toward a common clamping terminal, and a pair of screens or shades for the fixture removably connected to the said terminals.

6 Claims, 6 Drawing Figures

ORIENTABLE LIGHTING FIXTURE

FIELD OF THE INVENTION

The present invention relates to an orientable lighting fixture comprising a plurality of rods which are engaging a central supporting member and are flexibly converging in pairs each pair toward a common terminal connector so as to form the supporting frame for a pair of screens which serve as light-diffusors. The said central supporting member contains the bulb sockets and is orientable by means of a flange-stem combination suitably associated with the central support member so as to permit the location of the fixture on a wall or on the ceiling or on a column and to enable the positioning at will of the bulbs.

THE DRAWINGS

The invention will become more apparent from the following detailed description of the embodiments thereof and from the accompanying drawings, in which.

DETAILED DESCRIPTION OF THE INVENTION

Figure 4:
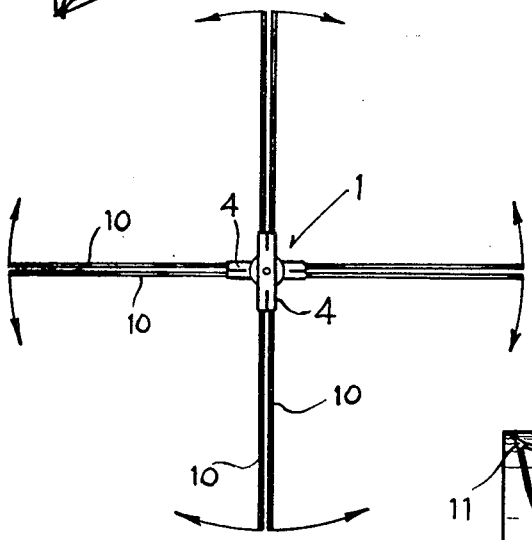
FIG. 4 shows the method of mounting the flexible rods on the central supporting member.
Figure 3:
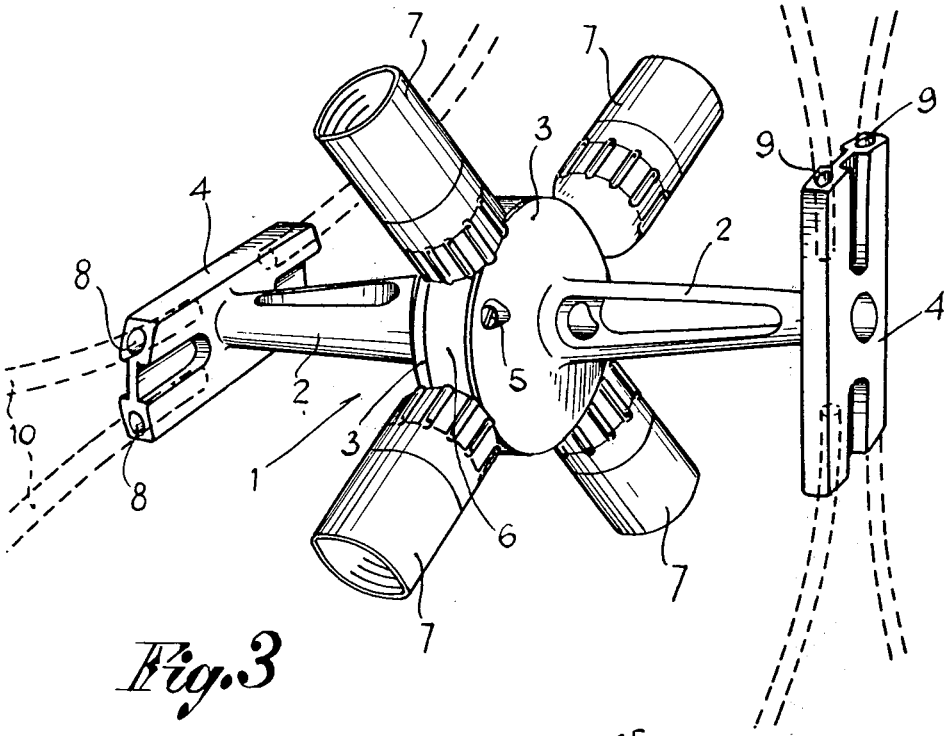
FIG. 3 is a perspective view of the central supporting member of the fixture.

With reference now to the accompanying drawings, the device of the invention comprises a central supporting member, generally indicated at 1, which comprises two identical portions, each consisting of a hollow stem 2, a base flange 3 and a rod-connector 4 (hereinafter referred to as the central rod connector 4) positioned perpendicularly with respect to the longitudinal axis of central stem 2. The two identical portions are fixedly attached to each other by means of fasteners, such as screws 5 (see FIG. 3) engaging the two base flanges 3 with a ring 6 positioned therebetween. On this ring 6 is furthermore mounted a number of bulb sockets 7 of conventional type. The two portions of the central support member are oppositely facing each other and are oriented angularly in such a way that their rod connectors 4 are perpendicularly mounted not only with respect to the longitudinal axis of stem 2 but also with respect to each other, so that, when the rods 10 are inserted into the connectors 4, a cross-like configuration will result, as it can be seen from FIG. 4. In each of the two central rod connectors 4, there are provided two pairs of longitudinal apertures 8, 9 open to the outside and each containing removably therein one extremity of one flexible rod 10 of suitable material, preferably plastic.

Figure 5:
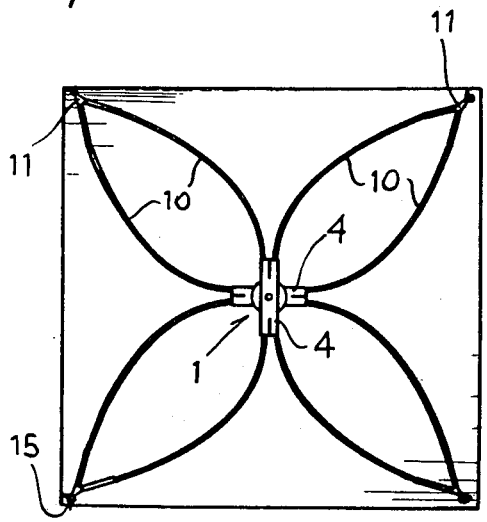
FIG. 5 shows the flexible rods of FIG. 4 convergingly assembled and with one screen connected thereto.
Figure 6:
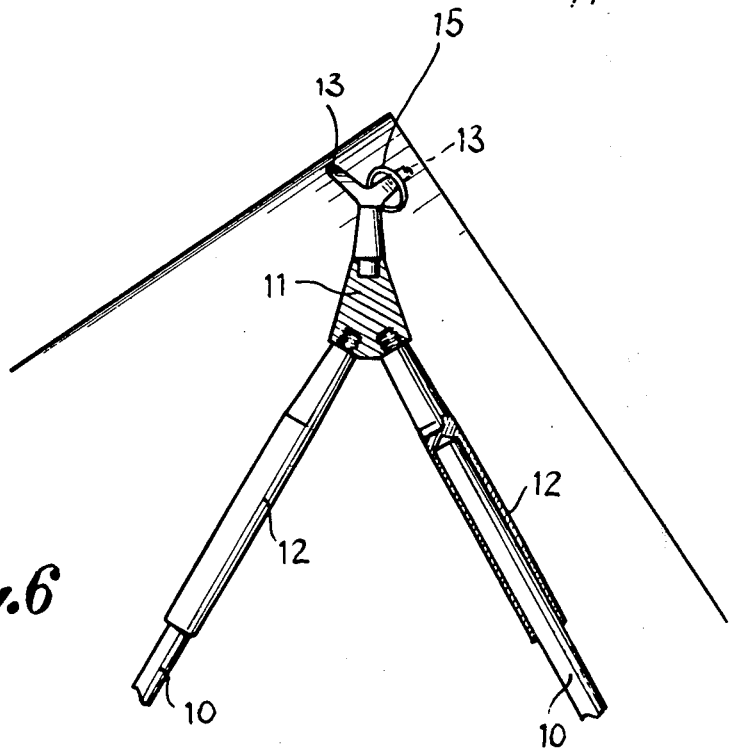
FIG. 6 is a partially cross-sectional view of the terminal connector for each pair of flexible rods, with one screen shown attached to the connector.

Each of the rods 10 associated with one of the two central rod connectors 4 is flexed or bent so as to converge, (see FIGS. 4, 5), together with a corresponding rod associated with the opposite central rod connector, toward a terminal or corner rod connector 11 (see FIG. 6) of V shape, and form consequently all together four pairs of corner rods. The terminal or corner rod connector 11 has a pair of longitudinal tubular seats 12 to accept therein the extremities of the rods 10 and, opposite thereto, a two-hook hanger 13.

The flexible rods 10, associated with the central support member 1, form all together four pairs of rods, the converging extremities of which, retained by the four V-shaped corner rod connectors 11, appear out of phase among themselves by 90 degrees with respect to the axis of the central support member and, furthermore, they appear positioned in correspondence with the apexes of a rectangle enclosing therein the entire lighting fixture. Furthermore, these rods thus assembled and mounted, constitute the supporting and tensile frame for a pair of screens 14, of suitable material, transparent or semi-transparent, held by means of rings 15 onto the hooks of the hanger 13. These two screens enclose therebetween the entire device and serve the purpose of light-diffusors.

Figure 1:
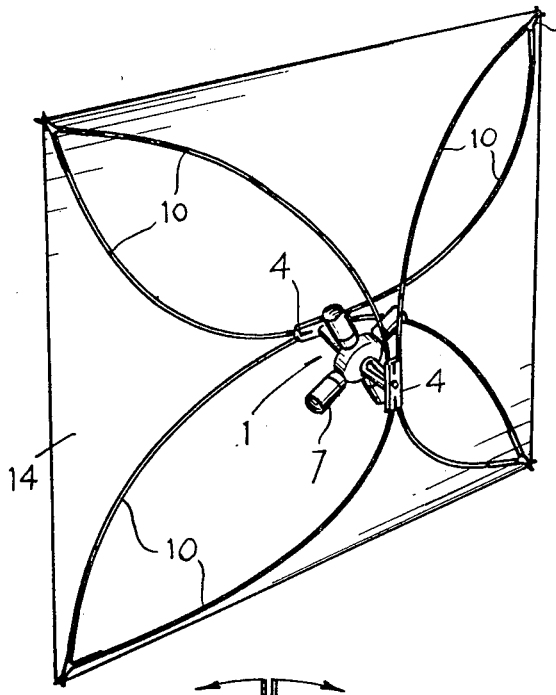
FIG. 1 is a perspective view of the assembled lighting fixture, one screen having been removed.
Figure 2:
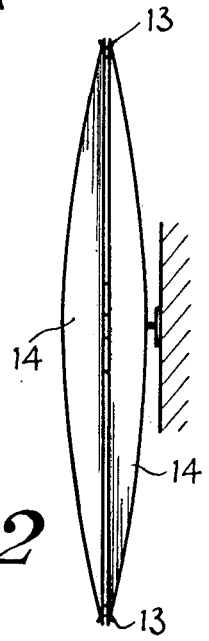
FIG. 2 is a side elevational view of the fixture in assembled condition.

The lighting fixture hereabove described is easily and rapidly assembled through the use of simple, easly interconnected, elements. A combination flange-stem (not referenced, but generally shown in FIG. 2) of conventional type is readily pivotably seated in the outer cavity centrally located in the central rod connectors 4, so as to permit the mounting of the device on a wall, on the ceiling or on a column or on any supporting base, thus resulting in a concurrently light-orientable and light-diffusion-controlled installation.

What is claimed is:

1. Orientable lighting fixture comprising:

a. a central support member having a plurality of light bulb sockets connected thereto:

b. a plurality of elongated flexible rods connected to said central support member;

c. a plurality of terminal connectors for coupling pars of said flexible rods at the extremity thereof that is remote from said central support member, each said pair of rods converging towards said terminal connector to define a corner; and d. a pair of screens attached removably onto said terminal connectors, said screens enveloping the entire lighting fixture and functioning as light-diffusors.

2. Lighting fixture according to claim 1, wherein said central support member comprises a central socket-bearing element and a pair of opposedly mounted portions, each said portion comprising a base flange removably fastened to said socket-bearing element, a hollow stem connected to said base flange, and a central connector connected to said hollow stem, the long axis of said central connector of one portion being perpendicular to the long axis of said central connector of said other opposedly mounted portion.

3. Lighting fixture according to claim 2, wherein each said central connector has two pairs of oppositely located apertures for accepting said flexible rods.

4. Lighting according to claim 3, wherein each said flexible rod which is associated with one aperture of one said central connector converges towards said flexible rod which is associated with one aperture of said opposite central connector and also toward a terminal connector common thereto, said two converging rods being connected with said common corner connector by means of tubular seats provided therein.

5. Lighting fixture according to claim 1, wherein said terminal connectors for the said converging pairs of flexible rods are positioned so as to form the apexes of a quadrilateral and be out of phase by 90° among themselves with respect to the axis of the central supporting member of the device.

6. Lighting fixture according to claim 1, further including mounting means pivotably connected with said central supporting member for orientably mounting the lighting fixture.

* * * * *